US012605802B2

(12) United States Patent
Oh et al.

(10) Patent No.: US 12,605,802 B2
(45) Date of Patent: Apr. 21, 2026

(54) CONDENSED GAS PAD CONDITIONER

(71) Applicant: Applied Materials, Inc., Santa Clara, CA (US)

(72) Inventors: Jeonghoon Oh, Saratoga, CA (US); Steven M. Zuniga, Soquel, CA (US); Brian J. Brown, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 583 days.

(21) Appl. No.: 17/963,099

(22) Filed: Oct. 10, 2022

(65) Prior Publication Data

US 2023/0390894 A1 Dec. 7, 2023

Related U.S. Application Data

(60) Provisional application No. 63/349,558, filed on Jun. 6, 2022.

(51) Int. Cl.

| | |
|---|---|
| ***B24B 53/017*** | (2012.01) |
| ***B24B 37/04*** | (2012.01) |
| ***B24B 41/00*** | (2006.01) |
| ***B24B 53/00*** | (2006.01) |
| ***B24B 55/02*** | (2006.01) |
| ***B24B 57/04*** | (2006.01) |

(52) U.S. Cl.

CPC ..... *B24B 53/017* (2013.01); *B24B 37/042* (2013.01); *B24B 41/005* (2013.01); *B24B 53/003* (2013.01); *B24B 55/02* (2013.01); *B24B 57/04* (2013.01)

(58) Field of Classification Search

None

See application file for complete search history.

(56) References Cited

U.S. PATENT DOCUMENTS

| | | | |
|---|---|---|---|
| 5,088,242 | A | 2/1992 | Lubbering et al. |
| 5,765,394 | A | 6/1998 | Rhoades |
| 5,868,003 | A | 2/1999 | Simas et al. |

(Continued)

FOREIGN PATENT DOCUMENTS

| | | | | |
|---|---|---|---|---|
| CN | 203991508 U | * | 12/2014 | ..... B24C 5/02 |
| CN | 106239356 A | | 12/2016 | |

(Continued)

OTHER PUBLICATIONS

Translation, CN-203991508-U (Year: 2014).*

(Continued)

*Primary Examiner* — David S Posigian
*Assistant Examiner* — Dana Lee Poon
(74) *Attorney, Agent, or Firm* — Fish & Richardson P.C.

(57) ABSTRACT

A polishing system including a platen to support a polishing pad, a carrier head to hold a substrate against the polishing pad, a source of dry ice particles, and a pad conditioner. The pad conditioner includes a compressor to generate a compressed gas stream, a mixer coupled to the source and the compressor to mix the dry ice particles with the compressed gas stream to form a stream of compressed gas with entrained dry ice particles, and a nozzle coupled to the mixer to direct the stream of compressed gas with entrained dry ice particles onto a polishing surface of the polishing pad at sufficient velocity to condition the polishing pad.

19 Claims, 4 Drawing Sheets

(56) References Cited

U.S. PATENT DOCUMENTS

| | | | | |
|---|---|---|---|---|
| 6,012,968 | A * | 1/2000 | Lofaro | B24C 3/22 451/39 |
| 6,023,941 | A | 2/2000 | Rhoades | |
| 6,036,583 | A | 3/2000 | Perlov et al. | |
| 6,151,913 | A | 11/2000 | Lewis et al. | |
| 6,174,225 | B1 * | 1/2001 | Becker | B24C 1/003 451/39 |
| 6,543,251 | B1 | 4/2003 | Gasteyer, III et al. | |
| 9,005,999 | B2 | 4/2015 | Xu et al. | |
| 10,058,975 | B2 | 8/2018 | Brown | |
| 11,897,079 | B2 | 2/2024 | Wu et al. | |
| 2002/0039874 | A1 | 4/2002 | Hecker et al. | |
| 2002/0058469 | A1 | 5/2002 | Pinheiro et al. | |
| 2004/0132388 | A1 * | 7/2004 | Kuhn | B24B 53/017 451/443 |
| 2005/0042877 | A1 | 2/2005 | Salfelder et al. | |
| 2009/0258573 | A1 | 10/2009 | Muldowoney et al. | |
| 2010/0047424 | A1 | 2/2010 | Cousin et al. | |
| 2010/0227435 | A1 | 9/2010 | Park et al. | |
| 2010/0227465 | A1 | 9/2010 | Jiang et al. | |
| 2013/0023186 | A1 | 1/2013 | Motoshima et al. | |
| 2013/0045596 | A1 | 2/2013 | Eda et al. | |
| 2014/0187122 | A1 | 7/2014 | Ishibashi | |
| 2015/0024661 | A1 * | 1/2015 | Peng | B08B 3/02 451/72 |
| 2020/0262024 | A1 * | 8/2020 | Chang | B24B 55/02 |
| 2021/0046602 | A1 * | 2/2021 | Wu | B24B 37/105 |
| 2021/0046604 | A1 * | 2/2021 | Wu | B24B 57/02 |

FOREIGN PATENT DOCUMENTS

| | | | | |
|---|---|---|---|---|
| JP | H11-216507 | | 8/1999 | |
| JP | 2000-354948 | A | 12/2000 | |
| JP | 2013-042066 | | 2/2013 | |
| JP | 2013-226628 | A | 11/2013 | |
| JP | 2015-009328 | | 1/2015 | |
| KR | 10-2007-0069941 | | 7/2007 | |
| KR | 10-2009-0046468 | | 5/2009 | |
| TW | 202120254 | | 6/2021 | |
| WO | WO-9502797 | A1 * | 1/1995 | C01B 32/55 |
| WO | WO 2002/017411 | | 2/2002 | |
| WO | WO 2014/113220 | | 7/2014 | |

OTHER PUBLICATIONS

Dgases.com [online], "Dry Ice Blasting," upon information and belief, available No. later than Nov. 18, 2021, retrieved on Jan. 7, 2025, retrieved from URL<http://www.dgases.com/index.php/dry-ice-blasting>, 3 pages.

International Search Report and Written Opinion in International Appln. No. PCT/US2022/077849, mailed on Mar. 2, 2023, 11 pages.

Office Action in Taiwanese Appln. No. 111138150, dated Nov. 17, 2023, 7 pages (with English search report).

Banerjee et al., "Post CMP Aqueous and CO2 Cryogenic Cleaning Technologies for Low k and Copper integration," CMPUG Symposium, Poster Abstract, Jan. 2015, 2 pages.

Office Action in Japanese Appln. No. 2024-571040, mailed on Jan. 6, 2026, 6 pages (with English translation).

* cited by examiner

CONDENSED GAS PAD CONDITIONER

CROSS-REFERENCE TO RELATED APPLICATIONS

This application claims the benefit of priority to U.S. Application No. 63/349,558, filed on Jun. 6, 2022, the contents of which are hereby incorporated by reference.

TECHNICAL FIELD

The present disclosure relates to chemical mechanical polishing, and more particularly to a polishing pad conditioner.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, a conductive filler layer is planarized until the top surface of a patterned layer is exposed. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. A polishing liquid is typically supplied to the surface of the polishing pad.

The polishing system typically includes a conditioner system to condition the polishing pad. Conditioning of the polishing pad maintains the polishing surface in a consistent roughness to ensure uniform polishing conditions from wafer-to-wafer. A conventional conditioner system has a conditioner head which holds a conditioner disk with an abrasive lower surface, e.g., with diamond particles, that is placed into contact with the polishing pad.

SUMMARY

In one aspect, a polishing system includes a platen to support a polishing pad, a carrier head to hold a substrate against the polishing pad, a source of dry ice particles, and a pad conditioner. The pad conditioner includes a compressor to generate a compressed gas stream, a mixer coupled to the source and the compressor to mix the dry ice particles with the compressed gas stream to form a stream of compressed gas with entrained dry ice particles, and a nozzle coupled to the mixer to direct the stream of compressed gas with entrained dry ice particles onto a polishing surface of the polishing pad at sufficient velocity to condition the polishing pad.

In another aspect, a method of conditioning a polishing pad includes mixing dry ice particles with a stream of compressed air to form a stream of compressed gas with entrained dry ice particles, and directing the stream of compressed gas with entrained dry ice particles through a nozzle onto a polishing surface of the polishing pad at sufficient velocity to condition the polishing pad.

Implementations may optionally include, but are not limited to, one or more of the following advantages.

A cold condensed gas may be more effective in conditioning and/or cleaning than a diamond abrasive disk. For example, sublimation of the condensed gas may lift debris off the polishing pad and may provide increased cleanliness. As another example, impact of particles of the condensed gas on the pad may reach a desired roughness faster. An entire radial length of the polishing pad can be conditioned at once, reducing or avoiding need for sweeping of the conditioning area and improving conditioning uniformity. Pad conditioning and/or cleaning time can be reduced, thus improving system duty cycle. The need for a replaceable conditioning disk that wears out is avoided, reducing polishing system down-time for maintenance for conditioning disk replacement. Accumulation of dried abrasive particles on a conditioning disk can be avoided, which may improve polishing quality by reducing scratches and defects. Productivity of the polishing system can be improved because less time is devoted to the pad conditioner cleaning process.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

During chemical mechanical polishing, the surface of the polishing pad can become smoother due to friction and compression, and polishing debris can be pressed into the polishing pad. The polishing system typically includes a conditioner system that has a conditioner head and a conditioner disk with an abrasive lower surface to condition the polishing pad and maintain the polishing pad at a consistent roughness from substrate-to-substrate and to remove polishing debris. However, the conditioning disk itself wears out and needs to be replaced periodically. This required shutting down the polishing system for maintenance. Moreover, abrasive slurry can splash and stick to the conditioning disk. A build-up of dried or coagulated polishing liquid on the polishing pad over time has multiple deleterious effects. For example, the larger particulates can be dislodged and return to the polishing surface, thus creating the danger of scratching and defects. A significant amount of non-productive time is required to clean the conditioner head and conditioner disk to prevent build-up of the dried polishing liquid.

An alternative technique for conditioning is to direct a jet of cold condensed gas, e.g., dry ice particles (i.e., solid $CO_2$), onto the polishing pad. If jetted at sufficiently high speed, the impact of the particles can abrade the polishing surface and loosen debris. Moreover, sublimation of the particles generates a gas that can carry away the debris.

Although the use of dry ice has been proposed for use in temperature control of the surface of the polishing pad, the operating regime to perform a conditioning process should be fairly different, e.g., higher velocity and larger particulate size. In short, use of dry ice for temperature control does not inherently result in a conditioning operation.

Figure 1:
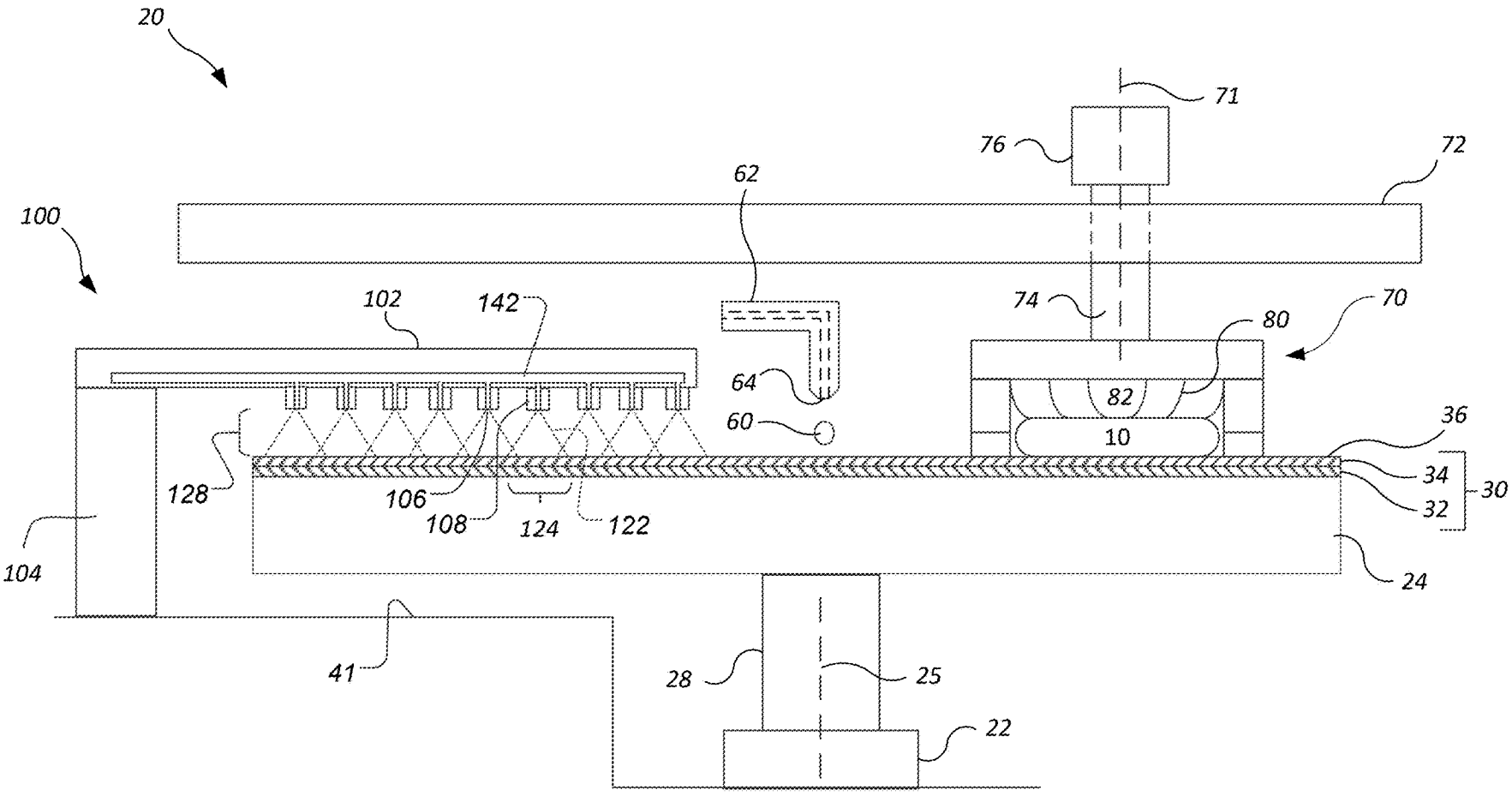
FIG. 1 is a schematic cross-sectional view of a polishing system that includes a pad conditioner system.

FIG. 1 shows a polishing system 20 operable to polish a substrate 10. The polishing system 20 includes a rotatable platen 24, on which a polishing pad 30 is situated. The platen 24 is operable to rotate (see arrow A in FIG. 2) about an axis 25. For example, a motor 22 can turn a drive shaft 28 to rotate the platen 24. The polishing pad 30 can be a two-layer polishing pad with an outer polishing layer 34 having a polishing surface 36 and a softer backing layer 32.

The polishing system 20 includes a supply port 64, e.g., at the end of a slurry supply arm 62, to dispense a polishing liquid 60, such as an abrasive slurry, onto the polishing pad 30.

The polishing system 20 includes a carrier head 70 operable to hold the substrate 10 against the polishing pad 30. The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head 70 is suspended from a support structure 72, for example, a carousel or track, and is connected by a carrier drive shaft 74 to a carrier head rotation motor 76 so that the carrier head 70 can rotate (see arrow B in FIG. 2) about an axis 71.

In addition, the carrier head 70 can oscillate (see arrow C in FIG. 2) laterally across the polishing pad 30, e.g., by moving in a radial slot in the carousel 72 as driven by an actuator, by rotation of the carousel as driven by a motor, or movement back and forth along the track as driven by an actuator. In operation, the platen 24 is rotated about its central axis 25, and the carrier head 70 is rotated about its central axis 71 and translated laterally across the top surface of the polishing pad 30.

Figure 2:
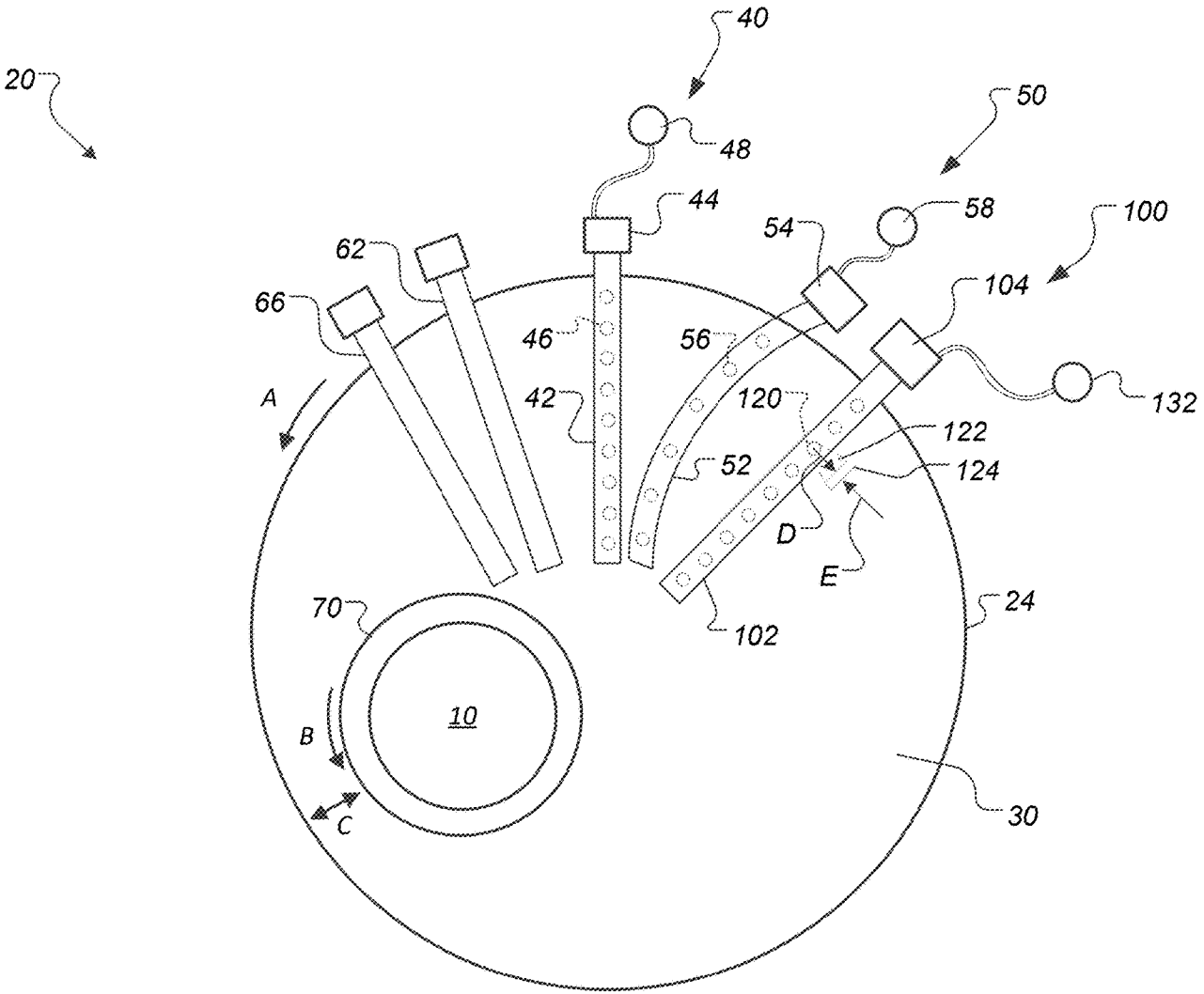
FIG. 2 is a schematic top view of the polishing system.

Referring to FIG. 2, in some implementations, the polishing system 20 includes a temperature control system 40 to control the temperature of the polishing pad 30 and/or slurry 60 on the polishing pad. The temperature control system 40 can provide a cooling system and/or a heating system. The temperature control system 40 can operate by delivering a temperature-controlled medium, e.g., a liquid, vapor or spray, from a source 48 onto the polishing surface 36 of the polishing pad 30 (or onto a polishing liquid that is already present on the polishing pad).

An example temperature control system 40 includes an arm 42 that extends over the platen 24 and polishing pad 30 from an edge of the polishing pad to or at least near (e.g., within 5% of the total radius of the polishing pad) the center of polishing pad 30. The arm 42 can be supported by a base 44, and the base 44 can be supported on the same frame 40 as the platen 24. The base 44 can include one or more actuators, e.g., a linear actuator to raise or lower the arm 42, and/or a rotational actuator to swing the arm 42 laterally over the platen 24. The arm 42 is positioned to avoid colliding with other hardware components such as the polishing head 70 and the slurry dispensing arm 62.

The arm 42 can include or support one or more apertures 46, e.g., nozzles, through which the temperature control medium is sprayed onto the polishing pad. Although FIG. 2 illustrates a single arm, there could be multiple arms, e.g., one arm dedicated for heating and one arm dedicated for cooling.

For cooling, the cooling medium can be a gas, e.g., air, or a liquid, e.g., water. The medium can be at room temperature or chilled below room temperature, e.g., at 5-15° C. In some implementations, the cooling system uses a spray of air and liquid, e.g., an aerosolized spray of liquid, e.g., water. In particular, the cooling system can have nozzles that generate an aerosolized spray of water that is chilled below room temperature. In some implementations, solid material can be mixed with the gas and/or liquid. The solid material can be a chilled material, e.g., ice, or a material that absorbs heat, e.g., by chemical reaction, when dissolved in water.

For heating, the heating medium can be a gas, e.g., steam or heated air, or a liquid, e.g., heated water, or a combination of gas and liquid. The medium is above room temperature, e.g., at 40-120° C., e.g., at 90-110° C. The medium can be water, such as substantially pure de-ionized water, or water that includes additives or chemicals. In some implementations, the temperature control system uses a spray of steam. The steam can include additives or chemicals.

The polishing system 20 can also include a high pressure rinse system 50. The high pressure rinse system 50 includes a plurality of nozzles 56, e.g., three to twenty nozzles that direct a cleaning fluid, e.g., water, at high intensity onto the polishing pad 30 to wash the pad 30 and remove used slurry, polishing debris, etc.

As shown in FIG. 2, an example rinse system 50 includes an arm 52 that extends over the platen 24 and polishing pad 30 from an edge of the polishing pad to or at least near (e.g., within 5% of the total radius of the polishing pad) the center of polishing pad 30.

The arm 52 can be supported by a base 54, and the base 54 can be supported on the same frame 40 as the platen 24. The base 54 can include one or more an actuators, e.g., a linear actuator to raise or lower the arm 52, and/or a rotational actuator to swing the arm 52 laterally over the platen 24.

The arm 52 is positioned to avoid colliding with other hardware components such as the polishing head 70, slurry dispensing arm 62, and temperature control system 40. Along the direction of rotation of the platen 24, the arm of the high pressure rinse system 50 can be between the slurry delivery arm 62 and the arm of the conditioner system.

In some implementations, the polishing system 20 includes a wiper blade or body 66 to evenly distribute the polishing liquid 60 across the polishing pad 30. Along the direction of rotation of the platen 24, the wiper blade 66 can be between the slurry delivery arm 62 and the carrier head 70.

The polishing system 20 can also include a high pressure rinse system 50. The high pressure rinse system 50 includes a plurality of nozzles 56, e.g., three to twenty nozzles that direct a cleaning fluid, e.g., water, at high intensity onto the polishing pad 30 to wash the pad 30 and remove used slurry, polishing debris, etc.

Referring to FIGS. 1 and 2, the polishing system 20 includes a conditioning system 100 that uses a jet of cold condensed gas to condition the polishing surface 36 of the polishing pad 30. An example conditioning system 100 includes an arm 102 that extends over the platen 24 and polishing pad 30 from an edge of the polishing pad to or at least near (e.g., within 5% of the total radius of the polishing pad) the center of polishing pad 30.

The arm 102 can be supported by a base 104, and the base 104 can be supported on the same frame 40 as the platen 24. The base 104 can include one or more an actuators, e.g., a linear actuator to raise or lower the arm 102, and/or a rotational actuator to swing the arm 102 laterally over the platen 24.

The arm 102 is positioned to avoid colliding with other hardware components such as the rinse system 50, temperature control system 40, slurry dispensing arm 62, and polishing head 70. Along the direction of rotation of the platen 24, the arm 102 of the conditioning system 100 can be between the carrier head 70 and the arm 42 of the temperature control system (if present) or the slurry dispensing arm 62. Along the direction of rotation of the platen 24, the components can be arranged in the following order: the arm 102 of the conditioning system 100, the arm 52 of the rinse system 50 (optional), the arm 42 of the temperature control system 40 (optional), the slurry dispensing arm 62, the wiper blade 66 (optional), and the polishing head 70.

The conditioning system 100 is configured to direct cold condensed gas through one or more openings 106, e.g., in one or more nozzles 108, that are formed in or suspended from the arm 102. In particular, the conditioning system can have a plurality of openings 106. The nozzles 108 can be convergent-divergent nozzles, e.g., Venturi nozzles. Each nozzle 108 can provide exactly one opening 106. In operation, the arm 102 can be supported by a base 104 so that the nozzles 108 are separated from the polishing pad 30 by a gap 128. The gap 128 can be 1 to 10 cm.

The various openings 106 can direct jets 122 of cold condensed gas onto different radial zones 124 on the polishing pad 30. Adjacent radial zones can overlap. Optionally, some of the openings 106 can be oriented so that a central axis (D) of the spray from that opening is at an oblique angle relative to the polishing surface 36. The jets can be directed from one or more of the openings 106 to have a horizontal component (D) in a direction opposite to the direction of motion (E) of polishing pad 30 in the region of impingement as caused by rotation of the platen 24.

Figure 1A:
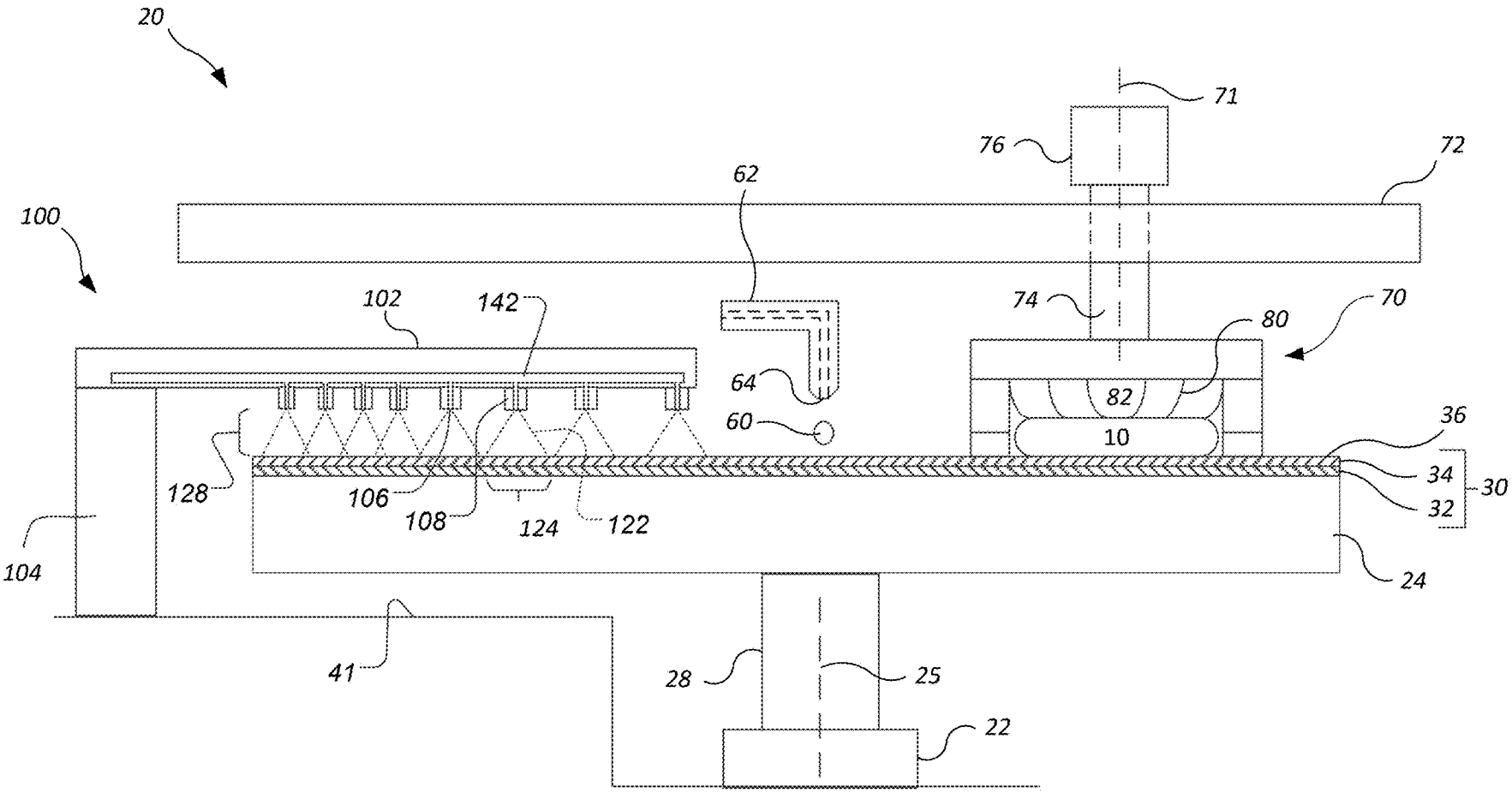
FIG. 1A is a schematic cross-sectional view of a polishing system that includes a pad conditioner system.

Although FIGS. 1 and 2 illustrate the openings 106 and nozzles 108 as spaced at even intervals, this is not required. Referring to FIG. 1A, the openings, e.g., the nozzles, could be distributed non-uniformly either radially, or angularly, or both. For example, as shown in FIG. 1A, openings 106 could be clustered more densely toward the outer edge of the polishing pad 30 (to compensate for the greater area being covered at the outer radius). In addition, although FIGS. 1 and 2 illustrate nine openings, there could be a larger or smaller number of openings.

The jets 122 of cold condensed gas can include cold solid particles of condensed gas that are carried by a carrier gas. In particular, the cold solid particles can be dry ice particles, i.e., solid carbon dioxide. The carrier gas can be air, or a purified gas such as nitrogen.

Figure 3:
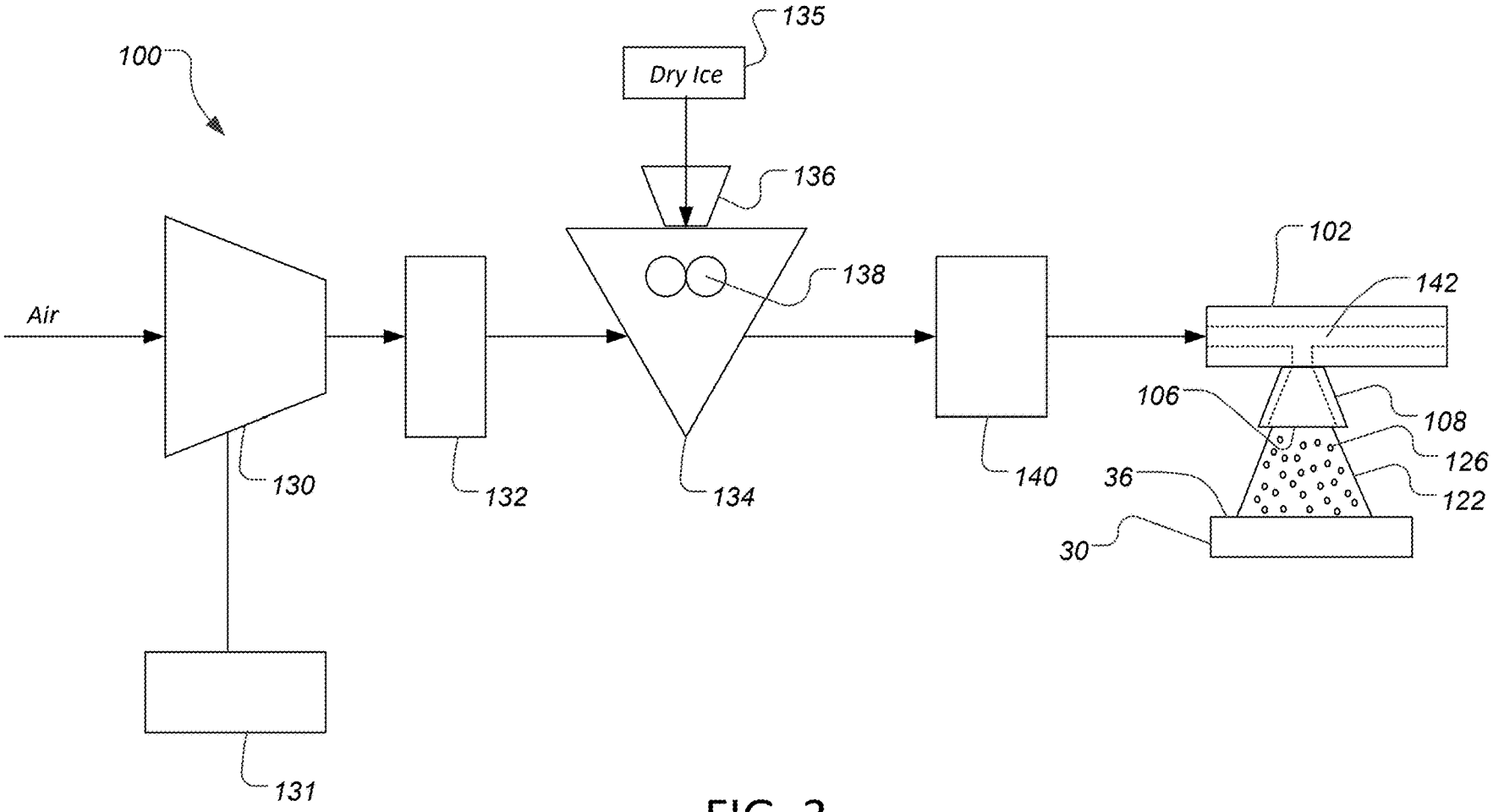
FIG. 3 is a schematic diagram of a conditioning system.

Referring to FIG. 3, an example conditioning system 100 draws in air into a compressor 130. The compressed air is directed through a drier 132 to remove excess water from the air stream. The compressed dry air is then mixed with dry ice in a mixer 134, e.g., the dry ice particles are entrained in the compressed air stream. The mixer 134 can include a feeder 136 to receive dry ice pellets or slabs from a source 135 of dry ice pellets or slabs, and a shredder 138, e.g., a pair of bladed rollers, to shred the large dry ice pieces into smaller particles suitable for entrainment into the compressed air stream.

The particles can have an average diameter of 0.05 to 5 mm, e.g., 0.1 to 1 mm. In some implementations, the particles can have an average diameter of at least 0.05 mm, e.g., at least 0.1 mm, e.g., at least 0.2 mm, e.g., at least 0.3 mm, e.g., at least 0.5 mm, e.g., at least 1 mm. In some implementations, the particles can have an average diameter of at most 0.1 mm, e.g., at most 0.2 mm, e.g., at most 0.3 mm, e.g., at most 0.5 mm, e.g., at most 2 mm, e.g., at most 3 mm, e.g., at most 5 mm.

Optionally the compressed air stream with entrained dry ice particles is directed through a strainer 140 to block dry ice particles above a threshold size.

The compressed air stream with entrained dry ice particles passes through an opening 106 of a nozzle 108 to form a jet 122 of dry ice particles 126 that is directed onto the surface 36 of the polishing pad 30. For example, the compressed air stream with entrained dry ice particles can pass through insulated conduit, e.g., provided by piping, tubing, etc., and a conduit 142 in the arm 102 to the nozzles 108. Although FIG. 3 illustrates a single nozzle, there can be multiple openings and multiple nozzles as shown in FIGS. 1 and 2.

As the compressed gas passes through the nozzle 108 or exits the opening 106, it can expand such that the dry ice particles are carried at high speed. The impact of the dry ice particles on the polishing surface and the sublimation of the dry ice can function to abrade the polishing pad 30 and/or to dislodge and carry away debris that is stuck on the polishing pad, thereby conditioning the polishing pad 30.

A velocity of the dry ice particles impact the polishing surface is controlled by a velocity of compressed air coming from the compressor 130. A controller 131 is coupled to the compressor 130 to control the velocity of the compressed air. In some implementations, the dry ice particles impact the polishing surface at a velocity up to Mach 1.5. In some implementations, the dry ice particles impact the polishing surface at a velocity of at least 50 m/s, e.g., at least 100 m/s, e.g., at least 150 m/s, e.g., at least 200 m/s, e.g., at least 250 m/s, e.g., at least 300 m/s, e.g., at least 343 m/s. In some implementations, the dry ice particles impact the polishing surface at a velocity of at most 100 m/s, e.g., at most 150 m/s, e.g., at most 200 m/s, e.g., at most 250 m/s, e.g., at most 300 m/s, e.g., at most 343 m/s (Mach 1), e.g., at most Mach 1.25. In some implementations, the dry ice particles reach supersonic speeds, i.e., above 343 m/s, within or at the exit of the nozzle.

A number of embodiments have been described. Nevertheless, it will be understood that various modifications may be made. Accordingly, other embodiments are within the scope of the following claims.

What is claimed is:

1. A polishing system, comprising:

a platen to support a polishing pad;

a carrier head to hold a substrate against the polishing pad;

a shredder configured to shred dry ice to form dry ice particles; and a pad conditioner including a compressor to generate a compressed gas stream, a drier to remove excess water from the compressed gas stream, a mixer coupled to the shredder and the drier to mix the dry ice particles with the compressed gas stream from the drier to form a stream of compressed gas with entrained dry ice particles, a strainer coupled to the mixer to block a portion of the entrained dry ice particles above a threshold size to form a stream of compressed gas with strained entrained dry ice particle, and a conditioner nozzle coupled to the strainer to direct the stream of compressed gas with the strained entrained dry ice particles onto a polishing surface of the polishing pad at sufficient velocity to condition the polishing pad.

2. The polishing system of claim 1, comprising a feeder to feed dry ice pellets to the shredder, wherein the shredder is configured to shred the dry ice pellets to form the dry ice particles.

3. The polishing system of claim 1, wherein the shredder is configured to form the dry ice particles with an average diameter of 0.1 to 5 mm, and wherein the threshold size of the dry ice particles is 5 mm.

4. The polishing system of claim 1, comprising a controller to operate the compressor such that the stream of compressed gas with the strained entrained dry ice particles impacts the polishing surface at the sufficient velocity, wherein a velocity of the sufficient velocity is in a range between 100 m/s and Mach 1.5.

5. The polishing system of claim 1, wherein the pad conditioner comprises an arm extending over the platen, wherein the pad conditioner comprises a plurality of conditioner nozzles coupled to the mixer to direct the stream of compressed gas with the strained entrained dry ice particles onto the polishing surface at sufficient velocity to condition the polishing pad.

6. The polishing system of claim 5, wherein the plurality of conditioner nozzles are spaced uniformly along the arm.

7. The polishing system of claim 5, wherein the plurality of conditioner nozzles are spaced non-uniformly along the arm.

8. The polishing system of claim 7, wherein the conditioner nozzles are spaced more densely closer to an edge of the platen than the center of the platen.

9. The polishing system of claim 5, further comprising a slurry supply arm having a port to dispense a polishing liquid to the polishing pad.

10. The polishing system of claim 9, further comprising a temperature control system including an arm supporting a nozzle to direct a temperature control medium onto the polishing pad.

11. The polishing system of claim 10, wherein the carrier head, the arm of the pad conditioner, the arm of the temperature control system, and the slurry supply arm are arranged in the stated order, starting with the carrier head, along a direction of rotation of the platen.

12. The polishing system of claim 10, further comprising a pad rinse system including an arm supporting a nozzle to direct a cleaning medium onto the polishing pad.

13. The polishing system of claim 12, wherein the carrier head, the arm of the pad conditioner, the arm of the pad rinse system, the arm of the temperature control system, and the slurry supply arm are arranged in the stated order starting with the carrier head along a direction of rotation of the platen.

14. A method of conditioning a polishing pad, comprising:

drawing a stream of air to form a stream of compressed air;

removing excess water from the stream of compressed air;

mixing dry ice particles with the stream of compressed air to form a stream of compressed gas with entrained dry ice particles;

directing the stream of compressed gas with entrained dry ice particles through a strainer to block a portion of the entrained dry ice particles above a threshold size to form a stream of compressed gas with strained entrained dry ice particle; and directing the stream of compressed gas with the strained entrained dry ice particles through a nozzle onto a polishing surface of the polishing pad at sufficient velocity to condition the polishing pad.

15. The method of claim 14, wherein the dry ice particles have an average diameter of 0.1 to 5 mm, and wherein the threshold size of the dry ice particles is 5 mm.

16. The method of claim 14, wherein the stream of compressed gas with the strained entrained dry ice particles flows through the nozzle at supersonic speed.

17. The method of claim 14, wherein the stream of compressed gas with the strained entrained dry ice particles impacts the polishing surface at a velocity between 100 m/s and Mach 1.5.

18. The method of claim 14, further comprising dispensing a temperature control medium through a second nozzle onto the polishing surface.

19. The method of claim 18, further comprising dispensing a rinsing fluid through a third nozzle onto the polishing surface.

* * * * *